US008786591B2

(12) United States Patent
Park et al.

(10) Patent No.: US 8,786,591 B2
(45) Date of Patent: Jul. 22, 2014

(54) PIXEL AND ORGANIC LIGHT EMITTING DISPLAY USING THE SAME

(75) Inventors: Yong-Sung Park, Yongin (KR); Deok-Young Choi, Yongin (KR); Ji-Hye Eom, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 669 days.

(21) Appl. No.: 13/030,085

(22) Filed: Feb. 17, 2011

(65) Prior Publication Data

US 2012/0038683 A1 Feb. 16, 2012

(30) Foreign Application Priority Data

Aug. 11, 2010 (KR) ..... 10-2010-0077315

(51) Int. Cl.
*G09G 5/10* (2006.01)
*G09G 3/30* (2006.01)

(52) U.S. Cl.
USPC ..... 345/212; 345/77; 345/78; 345/690

(58) Field of Classification Search
CPC ..... G09G 3/3233; G09G 2300/0814; G09G 2300/0819; G09G 2300/0852; G09G 2300/0861; G09G 2310/0262; G09G 2320/043; G09G 2320/045; G09G 2320/0219; G09G 2320/0233
USPC ..... 345/77, 78, 212, 690
See application file for complete search history.

(56) References Cited

U.S. PATENT DOCUMENTS

2009/0146987 A1* 6/2009 Kim et al. ..... 345/212
2011/0157144 A1* 6/2011 Park et al. ..... 345/212

FOREIGN PATENT DOCUMENTS

KR 10-2006-0056792 A 5/2006
KR 10-2006-0117690 A 11/2006
KR 10-2008-0022695 A 3/2008
KR 10-2008-0022696 A 3/2008

* cited by examiner

*Primary Examiner* — Amare Mengistu
*Assistant Examiner* — Jennifer Zubajlo
(74) *Attorney, Agent, or Firm* — Christie, Parker & Hale, LLP

(57) ABSTRACT

A pixel capable of reducing leakage current (to display an image with desired brightness) is provided. The pixel includes: an organic light emitting diode (OLED) coupled to a second power source; a first transistor for controlling an amount of current that flows from a first power source to the second power source via the OLED; a second transistor coupled between a data line and the first transistor, and configured to turn on when a scan signal is supplied to a scan line; a third transistor and a fourth transistor serially coupled between the first transistor and an initializing power source; and a fifth transistor coupled between a first node coupled to a gate electrode of the first transistor, and a second node that is a common node between the third transistor and the fourth transistor, and configured to turn off in a period where current is supplied to the OLED.

21 Claims, 6 Drawing Sheets

PIXEL AND ORGANIC LIGHT EMITTING DISPLAY USING THE SAME

CROSS-REFERENCE TO RELATED APPLICATION

This application claims priority to and the benefit of Korean Patent Application No. 10-2010-0077315, filed on Aug. 11, 2010, in the Korean Intellectual Property Office, the entire content of which is incorporated herein by reference.

BACKGROUND

1. Field

Aspects of embodiments according to the present invention relate to a pixel and an organic light emitting display using the pixel.

2. Description of the Related Art

Recently, various flat panel displays (FPDs) having reduced weight and volume when compared to those of cathode ray tube (CRT) devices have been developed. The FPDs include a liquid crystal display (LCD), a field emission display (FED), a plasma display panel (PDP), and an organic light emitting display.

Among the FPDs, the organic light emitting display displays images using organic light emitting diodes (OLEDs) that generate light by re-combination of electrons and holes. The organic light emitting display has high response speed and low power consumption. However, attempts to improve picture quality in organic light emitting displays can lead to problems such as increased power consumption or reduced aperture ratios in the corresponding pixels.

SUMMARY

Accordingly, embodiments of the present invention address these problems by providing a pixel capable of reducing or minimizing leakage current to display an image with desired brightness and an organic light emitting display using the same.

In an exemplary embodiment according to the present invention, a pixel is provided. The pixel includes an organic light emitting diode (OLED), a first transistor, a second transistor, a third transistor, a fourth transistor, and a fifth transistor. The OLED includes a cathode electrode coupled to a second power source. The first transistor is for controlling an amount of current that flows from a first power source to the second power source via the OLED. The first power source is coupled to a first electrode of the first transistor. The second transistor is coupled between a data line and the first electrode of the first transistor. The second transistor is configured to turn on when a scan signal is supplied to an ith (i is a natural number) scan line. The third transistor and the fourth transistor are serially coupled between a second electrode of the first transistor and an initializing power source. The fifth transistor is coupled between a first node and a second node. The first node is coupled to a gate electrode of the first transistor. The second nod is a common node between the third transistor and the fourth transistor. The fifth transistor is configured to turn off in a period where current is supplied to the OLED.

The third transistor may be configured to turn on when the scan signal is supplied to the ith scan line.

The fourth transistor may be configured to turn on when a scan signal is supplied to an (i-1)th scan line.

The fifth transistor may be configured to be on whenever the third transistor or the fourth transistor is turned on. The fifth transistor may be configured to be off in a period when the third transistor and the fourth transistor are turned off.

The pixel may further include a storage capacitor coupled between the first node and the first power source.

The pixel may further include a seventh transistor and a sixth transistor. The seventh transistor is coupled between the first electrode of the first transistor and the first power source. The seventh transistor is configured to be off when the fifth transistor is turned on. The sixth transistor is coupled between the second electrode of the first transistor and the OLED. The sixth transistor is configured to turn on and turn off concurrently with the seventh transistor.

The pixel may further include an eighth transistor coupled between the second node and a reference power source. The eighth transistor is configured to turn on and turn off concurrently with the sixth transistor.

The pixel may further include an eighth transistor coupled between the second node and the data line. The eighth transistor is configured to turn on and turn off concurrently with the sixth transistor.

The pixel may further include an eighth transistor coupled between the second node and a gate electrode of the fourth transistor. The eighth transistor is configured to turn on and turn off concurrently with the sixth transistor.

The fifth transistor may be formed by serially coupling a plurality of transistors.

In another exemplary embodiment according to the present invention, an organic light emitting display is provided. The organic light emitting display includes a scan driver, a data driver, and pixels. The scan driver is for supplying scan signals to scan lines, for supplying emission control signals to emission control lines, and for supplying inverted emission control signals to inverted emission control lines. The data driver is for supplying data signals to data lines. The pixels are located at crossing regions of the scan lines and the data lines. A pixel from among the pixels, positioned in an ith (i is a natural number) horizontal line, includes an organic light emitting diode (OLED), a first transistor, a second transistor, a third transistor, a fourth transistor, and a fifth transistor. The OLED includes a cathode electrode coupled to a second power source. The first transistor is for controlling an amount of current that flows from a first power source to the second power source via the OLED. The first power source is coupled to a first electrode of the first transistor. The second transistor is coupled between one of the data lines and the first electrode of the first transistor. The second transistor is configured to turn on when one of the scan signals is supplied to an ith scan line of the scan lines. The third transistor is coupled between a second electrode of the first transistor and a second node. The third transistor is configured to turn on when the one of the scan signals is supplied to the ith scan line. The fourth transistor is coupled between the second node and an initializing power source. The fourth transistor is configured to turn on when another of the scan signals is supplied to an (i−1)th scan line of the scan lines. The fifth transistor is coupled between the second node and a gate electrode of the first transistor. The fifth transistor is configured to turn on when one of the inverted emission control signals is supplied to an ith inverted emission control line of the inverted emission control lines.

The initializing power source may be configured to supply a lower voltage than the data signals.

The scan driver may be configured to supply the one of the inverted emission control signals to the ith inverted emission control line to overlap the one of the scan signals and the other of the scan signals respectively supplied to the ith scan line and the (i-1)th scan line.

The organic light emitting display may further include a storage capacitor coupled between the gate electrode of the first transistor and the first power source.

The organic light emitting display may further include a seventh transistor and a sixth transistor. The seventh transistor is coupled between the first electrode of the first transistor and the first power source. The seventh transistor is configured to turn off when one of the emission control signals is supplied to an ith emission control line of the emission control lines. The sixth transistor is coupled between the second electrode of the first transistor and the OLED. The sixth transistor is configured to turn off when the one of the emission control signals is supplied to the ith emission control line.

The scan driver may be configured to supply the one of the emission control signals to the ith emission control line whenever the one of the scan signals is supplied to the ith scan line or the other of the scan signals is supplied to the (i-1)th scan line.

The organic light emitting display may further include an eighth transistor coupled between the second node and a reference power source. The eighth transistor is configured to turn on and turn off concurrently with the sixth transistor.

The reference power source may be configured to supply a voltage that is not less than any of the data signals.

The organic light emitting display may further include an eighth transistor coupled between the second node and the one of the data lines. The eighth transistor is configured to turn on and to turn off concurrently with the sixth transistor.

The organic light emitting display may further include an eighth transistor coupled between the second node and a gate electrode of the fourth transistor. The eighth transistor is configured to turn on and turn off concurrently with the sixth transistor.

The fifth transistor may be formed by serially coupling a plurality of transistors.

According to the pixel of embodiments of the present invention and the organic light emitting display using the same, only one current leakage path exists from the gate electrode of the driving transistor so that leakage current may be reduced or minimized. In addition, according to embodiments of the present invention, the number of transistors positioned in the leakage current path may be reduced or minimized.

BRIEF DESCRIPTION OF THE DRAWINGS

The accompanying drawings, together with the specification, illustrate exemplary embodiments of the present invention, and, together with the description, serve to explain aspects and principles of the present invention.

DETAILED DESCRIPTION

Figure 1:
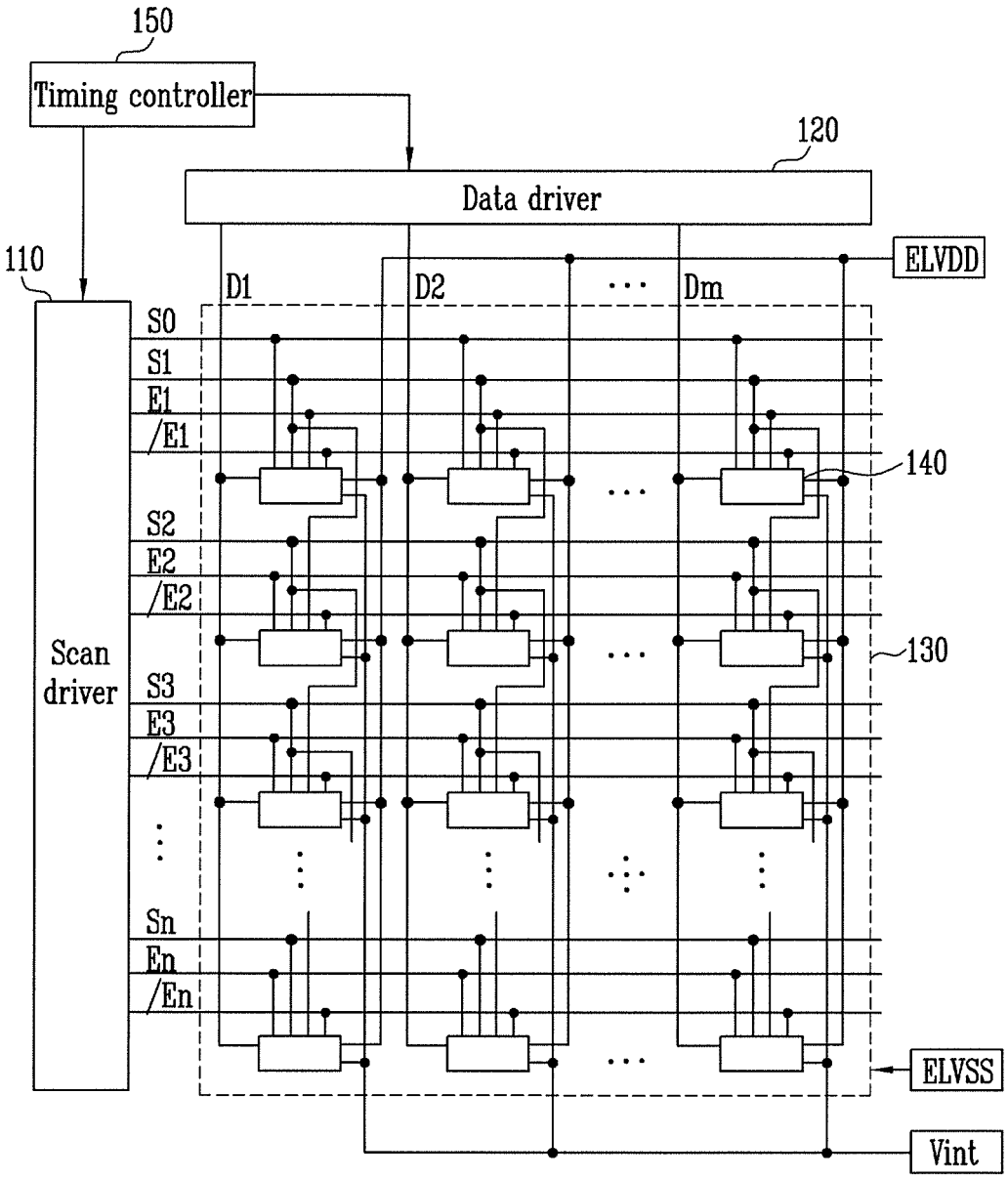
FIG. 1 is a view illustrating an organic light emitting display according to an embodiment of the present invention.

Hereinafter, certain exemplary embodiments according to the present invention will be described with reference to the accompanying drawings. Here, when a first element is described as being coupled to a second element, the first element may be not only directly coupled (for example, connected) to the second element but may also be indirectly coupled to the second element via one or more third elements. Further, some of the elements that are not essential to the complete understanding of the invention may be omitted for clarity. In addition, like reference numerals refer to like elements throughout.

An exemplary organic light emitting display includes a plurality of pixels arranged at crossing regions of a plurality of data lines, a plurality of scan lines, and a plurality of power source lines in a matrix. The pixels include organic light emitting diodes (OLEDs), driving transistors for controlling the amount of current that flows to the OLEDs, storage capacitors for charging the voltages corresponding to data signals, and compensating circuits for compensating for the threshold voltages of the driving transistors. The pixels charge the threshold voltages of the driving transistors and the voltages corresponding to the data signals in the storage capacitors and supply the current corresponding to the charged voltages to the OLEDs to display an image.

In order to display an image with desired gray levels by the pixels of the organic light emitting display, the voltages charged in the storage capacitors should be uniformly maintained. For example, a plurality of transistors may be serially coupled to a leakage current path to prevent the voltages of the storage capacitors from changing.

For instance, a plurality of transistors can be serially coupled to a first leakage current path coupled from the storage capacitors to the OLEDs and a second leakage current path coupled from the storage capacitors to an initial power source. However, although a plurality of transistors is serially coupled to the leakage current path as described above, an amount of leakage current (for example, an amount greater than a predetermined value) is still generated. In addition, the complexity of a pixel circuit increases with the plurality of serially coupled transistors and an aperture (for example, an aperture ratio) reduces at the same time.

Hereinafter, exemplary embodiments by which those skilled in the art can practice the present invention will be described in detail with reference to FIGS. 1 to 7.

FIG. 1 is a view illustrating an organic light emitting display according to an embodiment of the present invention.

Referring to FIG. 1, the organic light emitting display includes: a display unit 130 having pixels 140 coupled to scan lines S0 to Sn, emission control lines E1 to En, inverted emission control lines /E1 to /En, and data lines D1 to Dm; a scan driver 110 for driving the scan lines S0 to Sn, the emission control lines E1 to En, and the inverted emission control lines /E1 to /En; a data driver 120 for driving the data lines D1 to Dm; and a timing controller 150 for controlling the scan driver 110 and the data driver 120.

The scan driver 110 drives the scan lines S0 to Sn, the emission control lines E1 to En, and the inverted emission control lines /E1 to /En. That is, the scan driver 110 sequentially supplies scan signals to the scan lines S0 to Sn and sequentially supplies emission control signals to the emission control lines E1 to En. In addition, the scan driver 110 sequentially supplies inverted emission control signals to the inverted emission control lines /E1 to /En.

Here, an emission control signal supplied to an ith (i is a natural number) emission control line Ei and an inverted emission control signal supplied to an ith inverted emission control line /Ei overlap the scan signals supplied to an (i-1)th scan line Si-1 and an ith scan line Si. The emission control signal is set to have an opposite polarity to the polarity of the inverted emission control signal. For example, when the emission control signal is set to have a high-level voltage, the inverted emission control signal is set to have a low-level voltage.

The data driver 120 supplies data signals to the data lines D1 to Dm in synchronization with the scan signals supplied to the scan lines S1 to Sn. The timing controller 150 controls the scan driver 110 and the data driver 120.

The display unit 130 receives a first power from a first power source ELVDD, a second power from a second power source ELVSS, and an initializing power from an initializing power source Vint from the outside to supply the first power ELVDD, the second power ELVSS, and the initializing power Vint to the pixels 140. The pixels 140 initialize gate electrodes of driving transistors using the initializing power Vint and control an amount of current that flows from the first power source ELVDD to the second power source ELVSS via organic light emitting diodes (OLEDs) to correspond to the data signals. Therefore, the initializing power source Vint is set to supply a lower voltage than the data signals. In addition, the first power source ELVDD is set to supply a higher voltage than the second power source ELVSS.

Figure 2:
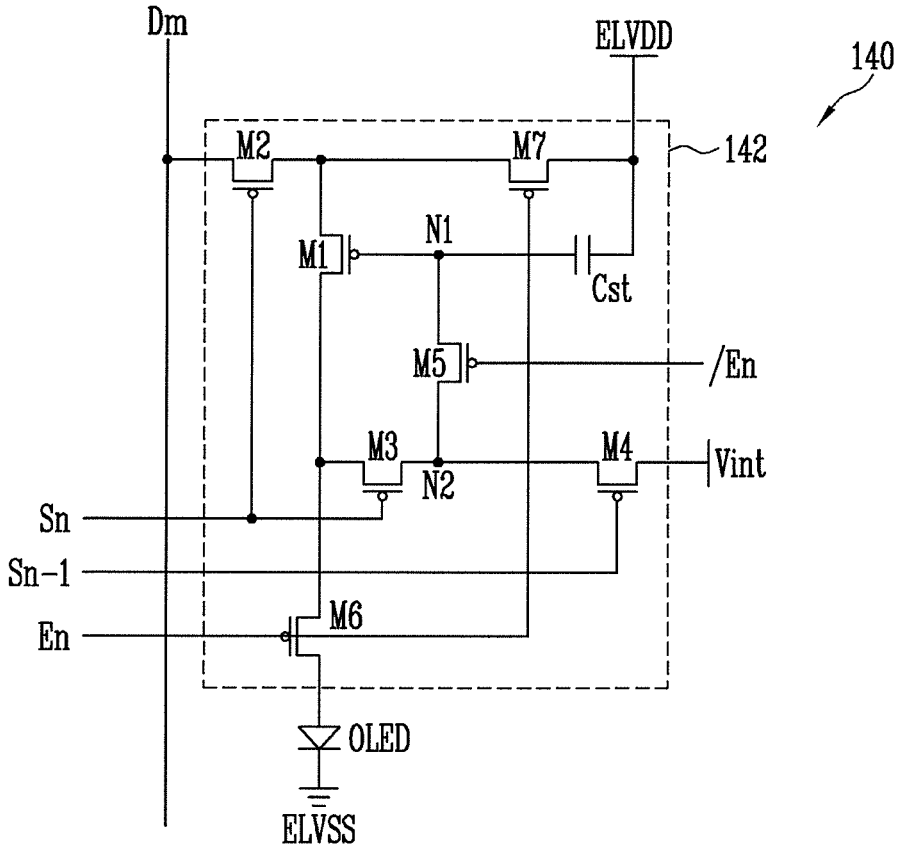
FIG. 2 is a view illustrating a first embodiment of the pixel of FIG. 1.

FIG. 2 is a view illustrating a first embodiment of the pixel 140 of FIG. 1. In FIG. 2, for convenience sake, the pixel 140 coupled to the (n-1)th scan line Sn-1, the nth scan line Sn, and the mth data line Dm will be described.

Referring to FIG. 2, the pixel 140 includes an OLED and a pixel circuit 142 coupled to the data line Dm, the scan lines Sn-1 and Sn, the emission control line En, and the inverted emission control line /En to control the amount of current supplied to the OLED.

An anode electrode of the OLED is coupled to the pixel circuit 142 and a cathode electrode of the OLED is coupled to the second power source ELVSS. The OLED generates light with brightness (for example, predetermined brightness) to correspond to the current supplied from the pixel circuit 142.

The pixel circuit 142 controls the amount of current supplied to the OLED to correspond to the data signal. Therefore, the pixel circuit 142 includes first to seventh transistors M1 to M7 and a storage capacitor Cst.

A first electrode of the first transistor M1 is coupled to a second electrode of the second transistor M2, and a second electrode of the first transistor M1 is coupled to a first electrode of the sixth transistor M6. A gate electrode of the first transistor M1 is coupled to a first node N1. The first transistor M1 controls the amount of current supplied to the OLED to correspond to the voltage applied to the first node N1.

Here, the first electrode is set as one of a drain electrode or a source electrode, and the second electrode is set as a different electrode from the first electrode. For example, when the first electrode is set as the source electrode, the second electrode is set as the drain electrode.

A first electrode of the second transistor M2 is coupled to the data line Dm, and the second electrode of the second transistor M2 is coupled to the first electrode of the first transistor M1. A gate electrode of the second transistor M2 is coupled to the nth scan line Sn. The second transistor M2 is turned on when the scan signal is supplied to the nth scan line Sn to electrically couple the data line Dm to the first electrode of the first transistor M1.

A first electrode of the third transistor M3 is coupled to the second electrode of the first transistor M1, and a second electrode of the third transistor M3 is coupled to a second node N2. A gate electrode of the third transistor M3 is coupled to the nth scan line Sn. The third transistor M3 is turned on when the scan signal is supplied to the nth scan line Sn to electrically couple the second electrode of the first transistor M1 to the second node N2.

A first electrode of the fourth transistor M4 is coupled to the second node N2, and a second electrode of the fourth transistor M4 is coupled to the initializing power source Vint. A gate electrode of the fourth transistor M4 is coupled to the (n-1)th scan line Sn-1. The fourth transistor M4 is turned on when the scan signal is supplied to the (n-1)th scan line Sn-1 to supply the voltage of the initializing power source Vint to the second node N2.

A first electrode of the fifth transistor M5 is coupled to the second node N2, and a second electrode of the fifth transistor M5 is coupled to the first node N1. A gate electrode of the fifth transistor M5 is coupled to the inverted emission control line /En. The fifth transistor M5 is turned on when the inverted emission control signal is supplied to the inverted emission control line /En to electrically couple the first node N1 to the second node N2.

The first electrode of the sixth transistor M6 is coupled to the second electrode of the first transistor M1, and a second electrode of the sixth transistor M6 is coupled to the anode electrode of the OLED. A gate electrode of the sixth transistor M6 is coupled to the emission control line En. The sixth transistor M6 is turned off when the emission control signal is supplied to the emission control line En and is turned on when the emission control signal is not supplied.

A first electrode of the seventh transistor M7 is coupled to the first power source ELVDD, and a second electrode of the seventh transistor M7 is coupled to the first electrode of the first transistor M1. A gate electrode of the seventh transistor M7 is coupled to the emission control line En. The seventh transistor M7 is turned off when the emission control signal is supplied to the emission control line En and is turned on when the emission control signal is not supplied.

The storage capacitor Cst is coupled between the first power source ELVDD and the first node N1. The storage capacitor Cst charges a voltage corresponding to a threshold voltage of the first transistor M1.

Figure 3:
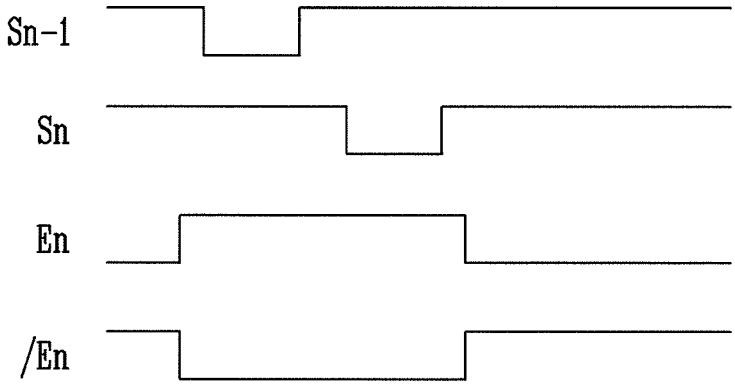
FIG. 3 is a waveform chart illustrating a method of driving the pixel of FIG. 2.

FIG. 3 is a waveform chart illustrating a method of driving the pixel 140 of FIG. 2.

Referring to FIG. 3, first, the emission control signal is supplied to the emission control line En and the inverted emission control signal is supplied to the inverted emission control line /En. When the emission control signal is supplied to the emission control line En, the sixth transistor M6 and the seventh transistor M7 are turned off. When the inverted emission control signal is supplied to the inverted emission control line /En, the fifth transistor M5 is turned on. When the fifth transistor M5 is turned on, the first node N1 and the second node N2 are electrically coupled to each other.

Then, the scan signal is supplied to the (n-1)th scan line Sn-1. When the scan signal is supplied to the (n-1)th scan line Sn-1, the fourth transistor M4 is turned on. When the fourth transistor M4 is turned on, the voltage of the initializing power source Vint is supplied to the second node N2 and the first node N1.

After the first node N1 is initialized to the voltage of the initializing power source Vint, the scan signal is supplied to the nth scan line Sn. When the scan signal is supplied to the nth scan line Sn, the second transistor M2 and the third transistor M3 are turned on.

When the third transistor M3 is turned on, the gate electrode of the first transistor M1 is electrically coupled to the second electrode. Therefore, the first transistor M1 is diode-connected.

When the second transistor M2 is turned on, the first electrode of the first transistor M1 is electrically coupled to the data line Dm. Then, the data signal from the data line Dm is supplied to the first electrode of the first transistor M1. Since the first node N1 is initialized to the voltage of the initializing power source Vint, the first transistor M1 is turned on to correspond to the data signal supplied to the first electrode thereof. When the first transistor M1 is turned on, the voltage obtained by subtracting the threshold voltage of the first transistor M1 from the voltage of the data signal is supplied to the first node N1. Then, the storage capacitor Cst charges a voltage (for example, a predetermined voltage) to correspond to the voltage applied to the first node N1.

Next, the supply of the emission control signal to the emission control line En is stopped, and the supply of the inverted emission control signal to the inverted emission control line /En is stopped. When the supply of the inverted emission control signal is stopped to the inverted emission control line /En, the fifth transistor M5 is turned off.

Further, when the supply of the emission control signal to the emission control line En is stopped, the sixth transistor M6 and the seventh transistor M7 are turned on. When the sixth transistor M6 is turned on, the first transistor M1 is electrically coupled to the OLED. When the seventh transistor M7 is turned on, the first power source ELVDD and the first transistor M1 are electrically coupled to each other. At this time, the first transistor M1 controls the amount of current that flows from the first power source ELVDD to the second power source ELVSS via the OLED to correspond to the voltage applied to the first node N1.

In the pixel 140 according to the embodiment of FIG. 2, the first node N1 is coupled to one transistor (that is, the fifth transistor M5). In this case, since the voltage charged in the first node N1 is charged via only one current leakage path (that passes through only the fifth transistor M5), leakage current may be reduced or minimized. In addition, in a period where the OLED emits light, the leakage current path that flows from the first node N1 to the initializing power source Vint passes through the fifth transistor M5 and the fourth transistor M4 that are set to be in an off state. The leakage current path that flows from the first node N1 to the OLED in a period where the OLED emits light passes through the fifth transistor M5 and the third transistor M3 that are set to be in an off state.

That is, in a period where the OLED emits light according to the present invention, the fifth transistor M5 and the fourth transistor M4 operate in the form of a dual gate and the fifth transistor M5 and the third transistor M3 operate in the form of a dual gate. In this case, leakage current may be reduced or minimized while forming the third transistor M3 and the fourth transistor M4 as one transistor.

Figure 4:
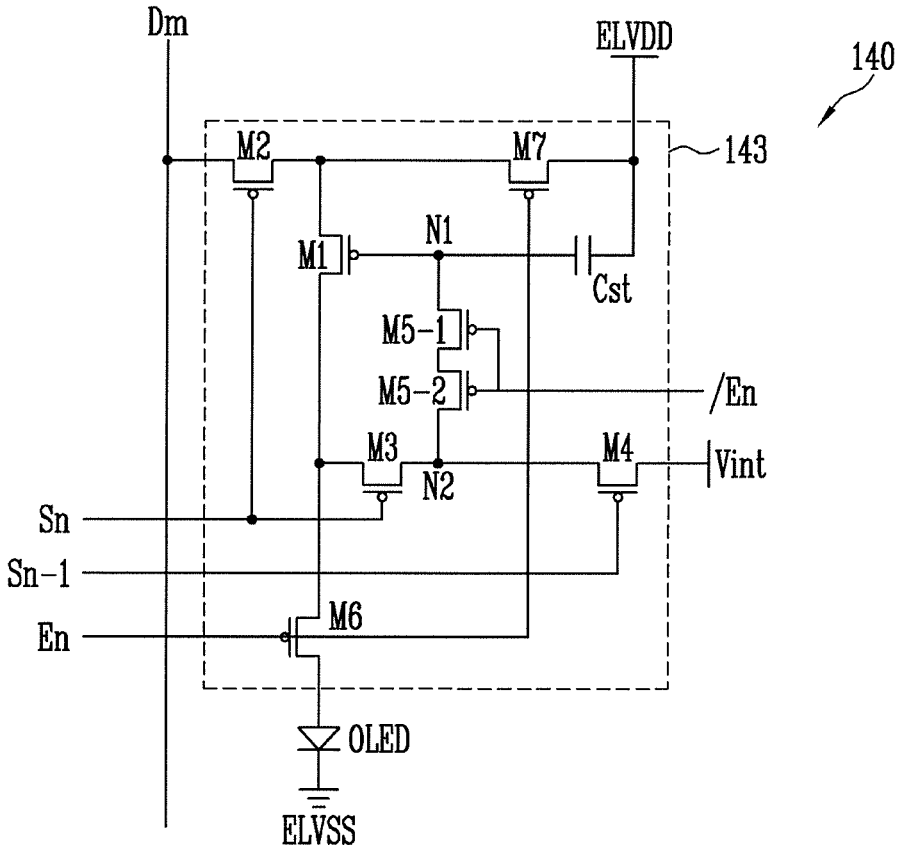
FIG. 4 is a view illustrating a second embodiment of the pixel of FIG. 1.

FIG. 4 is a view illustrating a second embodiment of the pixel 140 of FIG. 1. In FIG. 4, the same elements as the elements of FIG. 2 are denoted by the same reference numerals, and detailed description thereof will not be repeated.

Referring to FIG. 4, the pixel 140 includes an OLED and a pixel circuit 143 coupled to the data line Dm, the scan lines Sn-1 and Sn, the emission control line En, and the inverted emission control line /En to control the amount of current supplied to the OLED.

The pixel circuit 143 controls the amount of current supplied to the OLED to correspond to the data signal. The pixel circuit 143 includes a plurality of fifth transistors M5_1 and M5_2 serially coupled between the first node N1 and the second node N2. The gate electrodes of the fifth transistors M5_1 and M5_2 are coupled to the inverted emission control line /En. The fifth transistors M5_1 and M5_2 are turned on when the inverted emission control signal is supplied to the inverted emission control line /En to electrically couple the first node N1 and the second node N2 to each other.

In the above-described pixel 140 according to the second embodiment of the present invention, in order to reduce or minimize leakage current, the two fifth transistors M5_1 and M5_2 are formed between the first node N1 and the second node N2, and the other operation processes are the same as those of the pixel of FIG. 2. Therefore, detailed description of the pixel 140 according to the second embodiment of the present invention will not be repeated.

Figure 5:
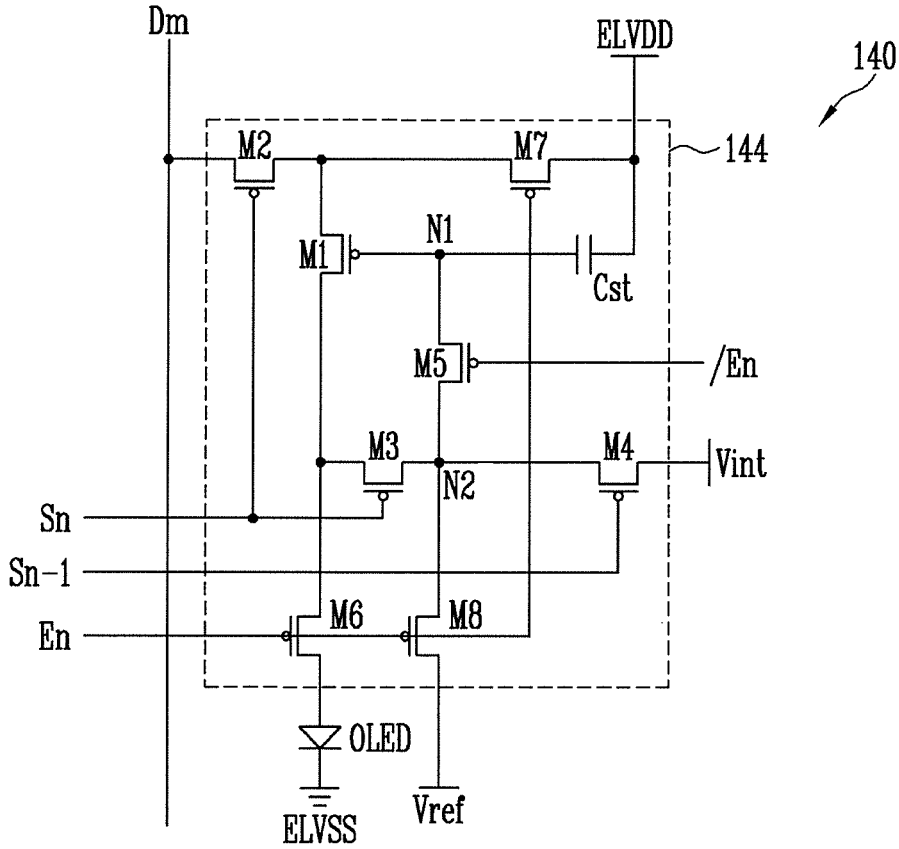
FIG. 5 is a view illustrating a third embodiment of the pixel of FIG. 1.

FIG. 5 is a view illustrating a third embodiment of the pixel 140 of FIG. 1. In FIG. 5, the same elements as the elements of FIG. 2 are denoted by the same reference numerals, and detailed description thereof will not be repeated.

Referring to FIG. 5, the pixel 140 includes an OLED and a pixel circuit 144 coupled to the data line Dm, the scan lines Sn-1 and Sn, the emission control line En, and the inverted emission control line /En to control the amount of current supplied to the OLED.

The pixel circuit 144 controls the amount of current supplied to the OLED to correspond to the data signal. The pixel circuit 144 further includes an eighth transistor M8 coupled between the second node N2 and a reference power source Vref. The eighth transistor M8 is turned off when the emission control signal is supplied to the emission control line En and is turned on in the other cases.

That is, the eighth transistor M8 is turned on when the OLED emits light to supply a voltage of the reference power source Vref to the second node N2. Here, the reference power source Vref is set to supply the same voltage as a highest one of the data signals or is set to supply a voltage higher than the data signals (that is, the voltage supplied by the reference power source Vref is not less than any of the data signals). Then, the leakage current that flows from the first node N1 to the second node N2 may be reduced or minimized by the voltage of the reference power source Vref supplied to the second node N2.

Figure 6:
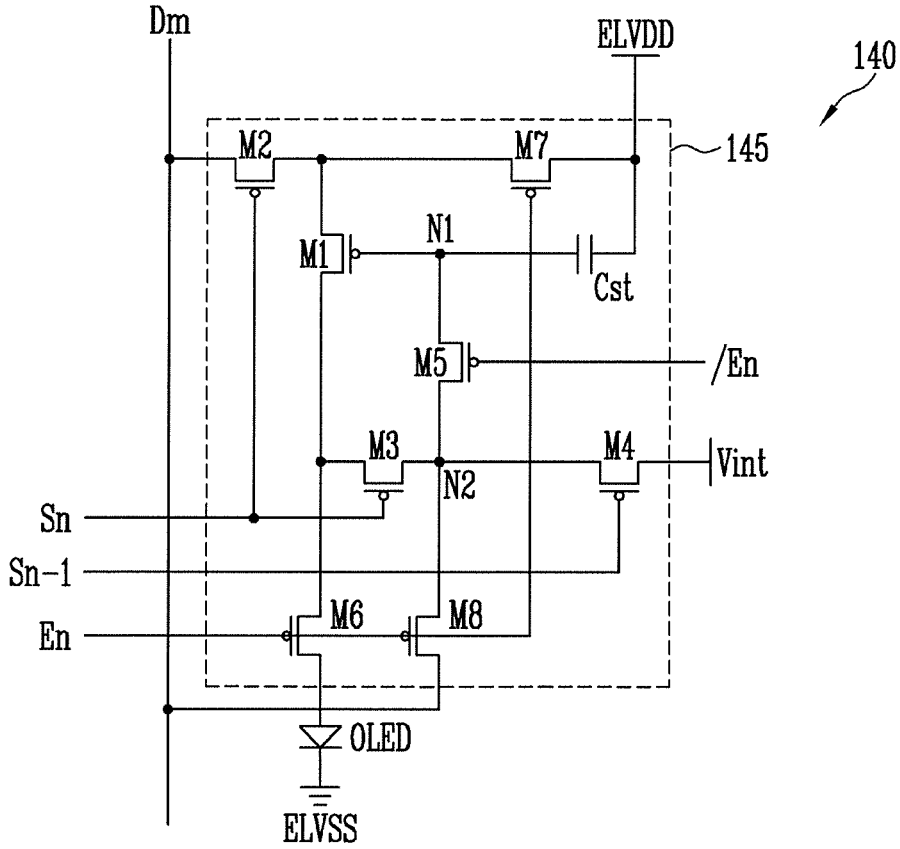
FIG. 6 is a view illustrating a fourth embodiment of the pixel of FIG. 1.

FIG. 6 is a view illustrating a fourth embodiment of the pixel 140 of FIG. 1. In FIG. 6, the same elements as the elements of FIG. 2 are denoted by the same reference numerals, and detailed description thereof will not be repeated.

Referring to FIG. 6, the pixel 140 includes an OLED and a pixel circuit 145 coupled to the data line Dm, the scan lines Sn-1 and Sn, the emission control line En, and the inverted emission control line /En to control the amount of current supplied to the OLED.

The pixel circuit 145 controls the amount of current supplied to the OLED to correspond to the data signal. The pixel circuit 145 further includes an eighth transistor M8 coupled between the second node N2 and a data line Dm. The eighth transistor M8 is turned off when the emission control signal is supplied to the emission control line En and is turned on in the other cases.

That is, the eighth transistor M8 is turned on when the OLED emits light to electrically couple the second node N2 to the data line Dm. Then, the data signal is supplied to the second node N2 in a period where the OLED emits light. In this case, since the voltage of the first node N1 is set to be similar to the voltage of the second node N2, leakage current that flows from the first node N1 to the second node N2 may be reduced or minimized.

Figure 7:
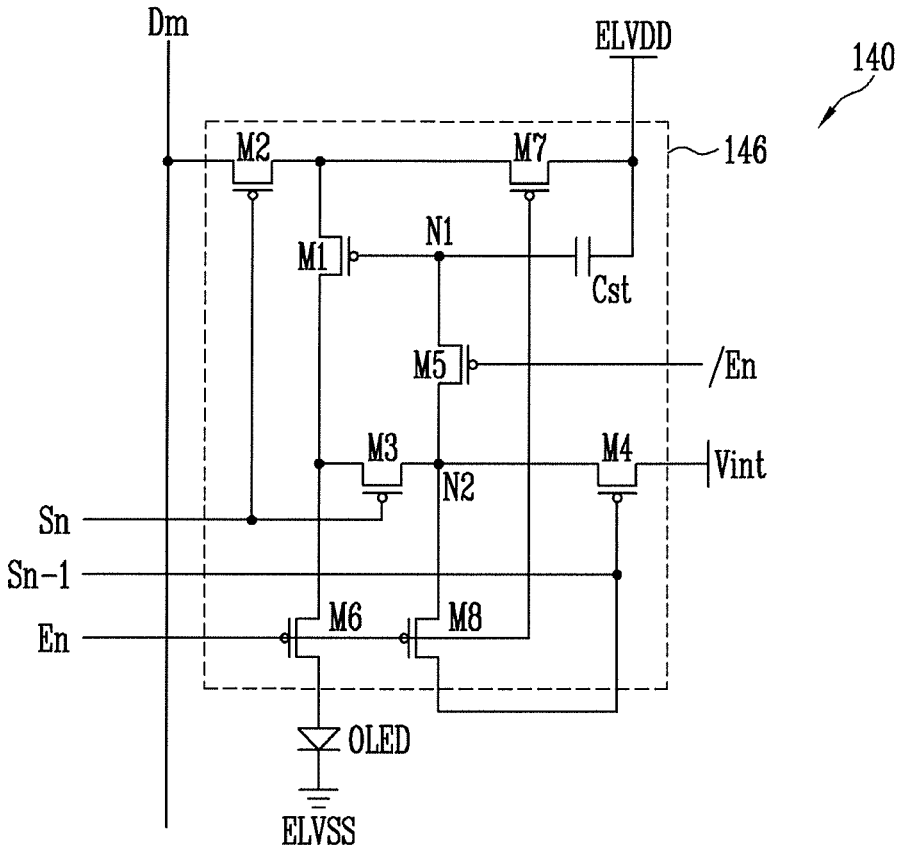
FIG. 7 is a view illustrating a fifth embodiment of the pixel of FIG. 1.

FIG. 7 is a view illustrating a fifth embodiment of the pixel 140 of FIG. 1. In FIG. 7, the same elements as the elements of FIG. 2 are denoted by the same reference numerals, and detailed description thereof will not be repeated.

Referring to FIG. 7, the pixel 140 according to the fourth embodiment of the present invention includes an OLED and a pixel circuit 146 coupled to the data line Dm, the scan lines Sn-1 and Sn, the emission control line En, and the inverted emission control line /En to control the amount of current supplied to the OLED.

The pixel circuit 146 controls the amount of current supplied to the OLED to correspond to the data signal. The pixel circuit 146 further includes an eighth transistor M8 having a first electrode coupled to the second node N2 and having a second electrode coupled to the gate electrode of the fourth transistor M4. The eighth transistor M8 is turned off when the emission control signal is supplied to the emission control line En and is turned on in the other cases.

That is, the eighth transistor M8 is turned on when the OLED emits light to electrically couple the second node N2 to the gate electrode of the fourth transistor M4. In this case, the fourth transistor M4 is diode-connected where current may flow from the initializing power source Vint to the second node N2. When the fourth transistor M4 is diode-connected, the leakage current that flows from the first node N1 to the initializing power source Vint in the period where the OLED emits light may be reduced or minimized.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel comprising:

an organic light emitting diode (OLED) comprising a cathode electrode coupled to a second power source;

a first transistor comprising a gate electrode coupled to and sharing a voltage of a first node for controlling an amount of current that flows from a first power source coupled to a first electrode of the first transistor, to the second power source via the OLED;

a second transistor coupled between a data line and the first electrode of the first transistor, and configured to turn on when a scan signal is supplied to an ith (i is a natural number) scan line;

a third transistor and a fourth transistor serially coupled between a second electrode of the first transistor and an initializing power source, a first electrode of the third transistor being coupled to the second electrode of the first transistor, a second node being a common node between the third transistor and the fourth transistor and sharing a common voltage between a second electrode of the third transistor and a first electrode of the fourth transistor; and a fifth transistor coupled between the first node and the second node, and configured to electrically disconnect the first node from the second node in a period when the current is supplied to the OLED.

2. The pixel as claimed in claim 1, wherein the third transistor is configured to turn on when the scan signal is supplied to the ith scan line.

3. The pixel as claimed in claim 1, wherein the fourth transistor is configured to turn on when a scan signal is supplied to an (i-1)th scan line.

4. The pixel as claimed in claim 1, wherein the fifth transistor is configured to be on whenever the third transistor or the fourth transistor is turned on, and is configured to be off in a period when the third transistor and the fourth transistor are turned off.

5. The pixel as claimed in claim 1, further comprising a storage capacitor coupled between the first node and the first power source.

6. The pixel as claimed in claim 1, further comprising:

a seventh transistor coupled between the first electrode of the first transistor and the first power source, and configured to be off when the fifth transistor is turned on; and a sixth transistor coupled between the second electrode of the first transistor and the OLED, and configured to turn on and turn off concurrently with the seventh transistor.

7. The pixel as claimed in claim 6, further comprising an eighth transistor coupled between the second node and a reference power source, and configured to turn on and turn off concurrently with the sixth transistor.

8. The pixel as claimed in claim 6, further comprising an eighth transistor coupled between the second node and the data line, and configured to turn on and turn off concurrently with the sixth transistor.

9. The pixel as claimed in claim 6, further comprising an eighth transistor coupled between the second node and a gate electrode of the fourth transistor, and configured to turn on and turn off concurrently with the sixth transistor.

10. The pixel as claimed in claim 1, wherein the fifth transistor is formed by serially coupling a plurality of transistors.

11. An organic light emitting display comprising:

a scan driver for supplying scan signals to scan lines, for supplying emission control signals to emission control lines, and for supplying inverted emission control signals to inverted emission control lines;

a data driver for supplying data signals to data lines; and pixels located at crossing regions of the scan lines and the data lines, wherein a pixel from among the pixels, positioned in an ith (i is a natural number) horizontal line, comprises:

an organic light emitting diode (OLED) comprising a cathode electrode coupled to a second power source;

a first transistor comprising a gate electrode coupled to and sharing a voltage of a first node for controlling an amount of current that flows from a first power source coupled to a first electrode of the first transistor, to the second power source via the OLED;

a second transistor coupled between one of the data lines and the first electrode of the first transistor, and configured to turn on when one of the scan signals is supplied to an ith scan line of the scan lines;

a third transistor comprising a first electrode coupled to a second electrode of the first transistor, and a second electrode coupled to and sharing a voltage of a second node, and configured to turn on when the one of the scan signals is supplied to the ith scan line;

a fourth transistor comprising a first electrode coupled to and sharing the voltage of the second nod; and a second electrode coupled to an initializing power source, and configured to turn on when another of the scan signals is supplied to an (i-1)th scan line of the scan lines; and a fifth transistor coupled between the second node and the first node, and configured to electrically connect the first node to the second node when one of the inverted emission control signals is supplied to an ith inverted emission control line of the inverted emission control lines.

12. The organic light emitting display as claimed in claim 11, wherein the initializing power source is configured to supply a lower voltage than the data signals.

13. The organic light emitting display as claimed in claim 11, wherein the scan driver is configured to supply the one of the inverted emission control signals to the ith inverted emission control line to overlap the one of the scan signals and the other of the scan signals respectively supplied to the ith scan line and the (i-1)th scan line.

14. The organic light emitting display as claimed in claim 11, further comprising a storage capacitor coupled between the gate electrode of the first transistor and the first power source.

15. The organic light emitting display as claimed in claim 11, further comprising:

a seventh transistor coupled between the first electrode of the first transistor and the first power source, and configured to turn off when one of the emission control signals is supplied to an ith emission control line of the emission control lines; and a sixth transistor coupled between the second electrode of the first transistor and the OLED, and configured to turn off when the one of the emission control signals is supplied to the ith emission control line.

16. The organic light emitting display as claimed in claim 15, wherein the scan driver is configured to supply the one of the emission control signals to the ith emission control line whenever the one of the scan signals is supplied to the ith scan line or the other of the scan signals is supplied to the (i-1)th scan line.

17. The organic light emitting display as claimed in claim 15, further comprising an eighth transistor coupled between the second node and a reference power source, and configured to turn on and turn off concurrently with the sixth transistor.

18. The organic light emitting display as claimed in claim 17, wherein the reference power source is configured to supply a voltage that is not less than any of the data signals.

19. The organic light emitting display as claimed in claim 15, further comprising an eighth transistor coupled between the second node and the one of the data lines, and configured to turn on and to turn off concurrently with the sixth transistor.

20. The organic light emitting display as claimed in claim 15, further comprising an eighth transistor coupled between the second node and a gate electrode of the fourth transistor, and configured to turn on and turn off concurrently with the sixth transistor.

21. The organic light emitting display as claimed in claim 11, wherein the fifth transistor is formed by serially coupling a plurality of transistors.

* * * * *